US005816199A

United States Patent [19]

Khizh et al.

[11] Patent Number: 5,816,199

[45] Date of Patent: Oct. 6, 1998

[54] HIGH EFFICIENCY WATER HEATER

[75] Inventors: Adam Khizh; Serguri Khiy, both of New York, N.Y.

[73] Assignee: AGA Technologies, Inc., Langhorne, Pa.

[21] Appl. No.: 786,324

[22] Filed: Jan. 23, 1997

[51] Int. Cl.[6] ..... F22B 23/06

[52] U.S. Cl. ..... 122/367.1; 122/367.2; 122/367.3; 122/13.1; 122/17; 126/350 R; 126/361; 126/362

[58] Field of Search ..... 122/367.1, 367.2, 122/367.3, 13.1, 14, 17, 20 B; 126/350 R, 361, 362

[56] References Cited

U.S. PATENT DOCUMENTS

| | | | |
|---|---|---|---|
| 4,438,728 | 3/1984 | Fracaro | 126/362 |
| 4,479,484 | 10/1984 | Davis | 126/362 |
| 4,679,528 | 7/1987 | Krans et al. | 122/367.3 |
| 4,732,590 | 3/1988 | McNeil | 122/367.2 |
| 4,782,815 | 11/1988 | Friedman et al. | 126/362 |
| 4,993,402 | 2/1991 | Ripka | 126/361 |
| 5,365,888 | 11/1994 | Aronov | 122/367.1 |
| 5,544,645 | 8/1996 | Armijo et al. | 126/361 |

*Primary Examiner*—Teresa J. Walberg
*Assistant Examiner*—Jiping Lu
*Attorney, Agent, or Firm*—Panitch Schwarze Jacobs & Nadel, P.C.

[57] ABSTRACT

A water heater having a vertical tank and a coil pipe located coaxial around the tank with a vertical ring space between them that serves as a ring combustor (bottom portion) and a flue for hot gases (upper portion). Assembly of low pressure (from about 500 Pa) plenum blower with air-blast gas burner is located right beneath of ring combustor. The burner's nozzle enters into the ring combustor tangentialy. A venting tangential outlet is located on top of the ring flue. The tank's water inlet ends with a nozzle having tangential direction. It is another water heater with two coaxial vertical coil pipes with a ring space between them and without a tank for hot water. The means for combusting fuel and venting gases are the same as in the preceding object.

16 Claims, 5 Drawing Sheets

HIGH EFFICIENCY WATER HEATER

BACKGROUND—FIELD OF INVENTION

This invention relates to a power vented water heater and a method of combusting a fuel and heating water. More particularly, it is related to a gas fired commercial water heater or hot water supply boiler wherein the products of combustion flow directly from the burner inside vertical flue, the walls of which or pipes are washing with heated water.

BACKGROUND—DESCRIPTION OF THE PRIOR ART

The common ordinary water heaters of the prior art (U.S. Pat. No. 4,672,919; 5,020,512; 5,199,385; 5,335,646 etc.) have typically relied upon the atmospheric injection gas burner located under the central vertical flue pipe of the tank with heating water. By action of natural draft of hot flue gases, or by means of the exhauster the products of combustion flow upwards through the flue pipe, which serves as a heat transfer surface for heating water. Different flue baffles can be placed into the flue pipe to increase coefficient of heat transmission. The thermal efficiency of these water heaters usually is 76–80%.

The reasons for such low thermal efficiency are the following: first, high temperature of the outlet products of combustion can reach 200° C. and second, extra air in products of combustion is 3–4 times above stiochiometric rate for complete combustion.

The first reason is a result of low thermal conductance factor between products of combustion and the flue pipe inside surface because of low speed of hot gases usually 4–6 m/s and not more than 8–10 m/s. The second reason lies in the atmospheric gas burner. These drawbacks are inherent in method of gas combustion and in order to eliminate them it is necessary to change a method of fuel combustion and a water heater construction, which is suggested in present invention.

Multi-flue constructions are used to increase a productivity of commercial water heaters, (e.g., by U.S. Pat. No. 4,157,077 (1979), 4,512,289 (1985) and others) with a lot of welds, which shorten a water heaters life. Moreover, special means are required to prevent a sedimentation in such wide tank, e.g., as in one of the last U.S. Pat. No. 5,341,770 (1994).

To increase an amount of heat transmission inside flue pipe different baffles are used. The patents of Oscar Bock in 1955 and 1960 on an internally finned flue provided additional heating surface and turbulence. With this "Turboflue" 30 Gal. water heater reached 140,000 BTU/H input. But these constrictions are very complicated and contain a great number of welds.

OBJECTS AND ADVANTAGES OF THE INVENTION

It is an object of the present invention to provide a water heater with the minimum requirement of a fuel, i.e., thermal efficiency 90–95%, for commercial use from 200,000 up to 4,000,000 and more BTU/H input and the manufacturing cost of which is much less than cost of the ordinary commercial models of the same productivity.

It is additional advantage of the invention—to decrease the overall dimensions of the water heater (boiler) materially.

It is a further advantage of the invention—to prolong life of water heaters by eliminating sedimentation of solid particles in a bottom of a water heater tank and so by eliminating any welded joints that are in contact with the products of combustion with temperature above 200° C.

It is another advantage of the invention to provide a water heater capable of venting flue gases at a comparatively low temperature without an additional exhauster or a chimney stack.

It is another object of this invention to provide very simple and effective method of combusting fuel, venting, and heating water in the water heater with vertical flue.

Other objects and advantages of the present invention will become apparent to those skilled in the art from the drawings the detailed description of preferred embodiments and the appended claims.

SUMMARY OF THE INVENTION

A water heater according to the present invention has a vertical tank and a vertical coil pipe located coaxial around the tank. A vertical ring space between the coil pipe and the tank is used as a combustion chamber and flue for products of combustion. A burner which is connected with a low pressure (from about 500 Pa) plenum blower and a fuel source is located under the ring space. The burner nozzle enters into the ring combustor through the bottom end with a tangential direction and aslant up from horizontal to about 20°. A venting tangential outlet is located on top of the ring flue. The cold water inlet is connected with the coil pipe. The other coil pipe's end is joined with the tank's water inlet ending with a nozzle which is directed tangential to the wall into a bottom portion of the tank.

It is another water heater according the present invention with two vertical coil pipes located coaxial one inside the other. The ring space between the coil pipes used as a ring combustor and a vertical ring flue. A burner is connected with a low pressure (from about 500 Pa) plenum blower and a fuel source. A burner's nozzle enters in the ring space between the coil pipes through a bottom with a tangential direction. A venting tangential outlet is located near the top end of the coil pipes. The coil pipes are joined together with their inlet and outlet ends.

A method of combusting fuel, venting and heating water comprising: preparing a fuel/air mixture up to 100% and more of stoichiometric ratio for complete combustion, blowing the mixture with a velocity from about 25 m/s into a vertical ring combustor with a tangential direction to inside surface and aslant up from horizontal at angles to about 20°, complete combustion of the fuel/air mixture in the whirling stream-flame, heating water mostly by convection heat transfer from a whirling stream products of combustion and venting products of combustion under a natural draft of hot gases and directed tangential force from the whirling stream of products of combustion.

DRAWING REFERENCE NUMERALS

Figure 1:
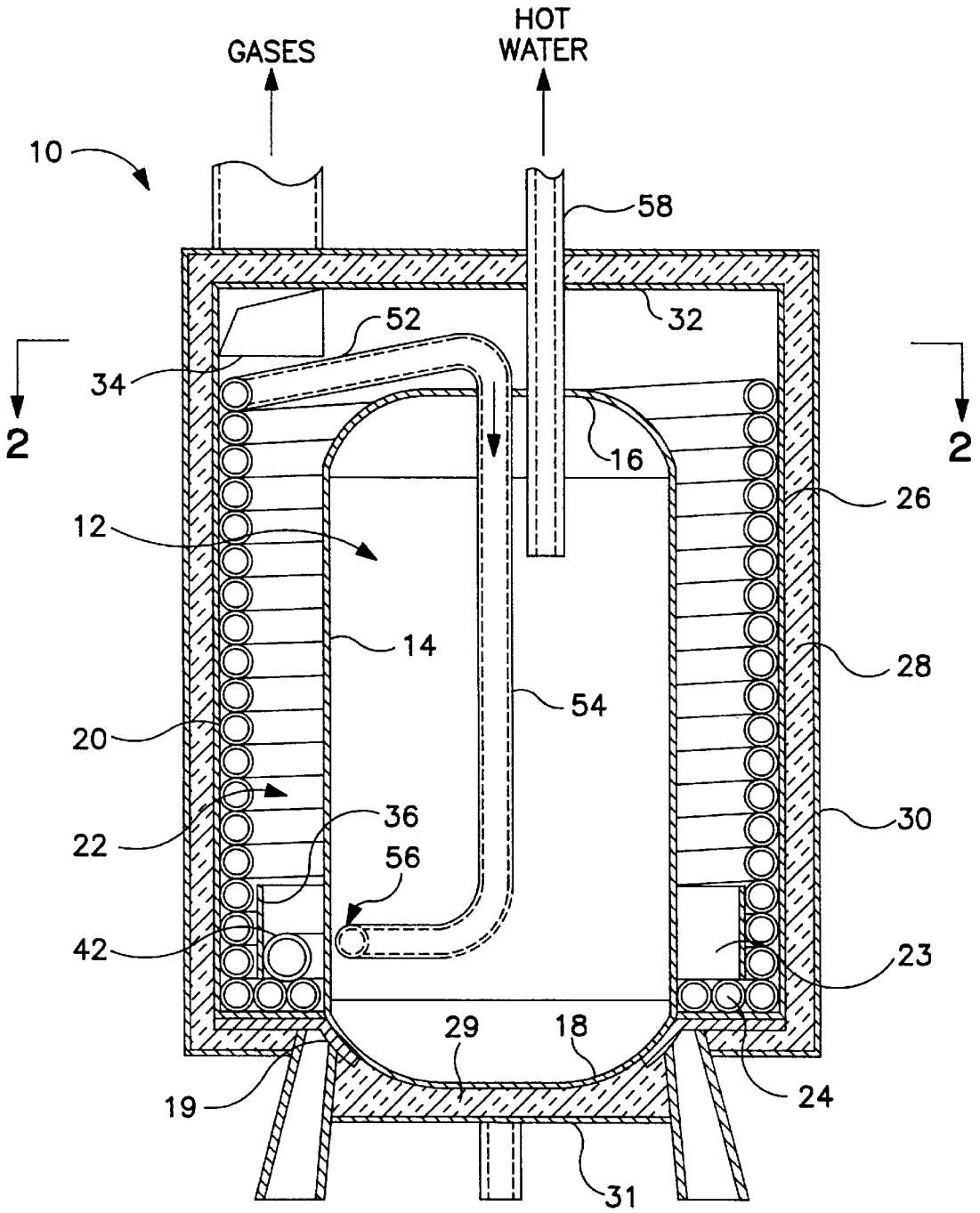
FIG. 1 is a schematic cross-sectional side view of a water heater illustrating one embodiment of the present invention.

10 water heater
12 tank for hot water
14 wall of 12
16 top of 12
18 bottom of 12
19 supporting frame
20 outer coil pipe
22 ring flue
23 ring combustor
24 bottom spires of 20
26 metal screen
28 insulation
29 insulation of 18
30 jacket over 28
31 jacket over 29
32 top cover over 22
34 tangential outlet
36 fireproof tube screen in 23
38
40 air-blast gas burner
42 burner nozzle
44 gas inlet into 40
46 plenum blower
48
50 bottom end of 20
52 top end of 20
54 central tube
56 nozzle of 54
58 hot water outlet
60 water heater
62 additional coil pipe
64 top end of 62
66 wavy wall of 12
68
70 water heater
72 inner coil pipe
74 barrel
76 bottom end of 74
78 cold water inlet
80 fireproof tube screen
82 abutting end of 42

DESCRIPTION OF THE PREFERRED EMBODIMENT

It will be appreciated that the following description is invented to refer to the specific embodiment of the invention selected for illustration in the drawings and is not intended to define or limit the invention other than in the appended claims. Turning now to the specific form of the invention illustrated in the drawings and referring particularly to FIGS. 1 and 2, the number 10 designates a water heater in accordance with aspects of the invention.

FIG. 1 shows water heater 10 taken in section to show the interior thereof. The water heater includes a liquid tight vertical tank 12 comprised of a tank wall 14 and top and bottom head members 16 and 18 welded thereto. The tank is located coaxial inside a vertical coil pipe 20. There is some vertical ring space between the coil pipe 20 and the tank 12. The upper most portion of that space is a ring flue 22 for hot gases, the bottom portion of the ring flue is the ring combustor 23. The bottom end of the ring combustor is closed with additional "bottom spires" 24 of coil pipe.

The tank 12 as well as the coil pipe 20 are rest on a supporting frame 19.

The outer coil pipe can have yawns between the spires for extension active surface of heat exchange. In this case an additional outside metal tube screen 26 is placed close to the outer surface of that coil pipe. The metal screen 26 is surrounded by a body of insulation 28 which is in turn surrounded by an exterior jacket 30. The bottom 18 is surrounded by a body of insulation 29 that is coated by a jacket 31.

A plenum blower 46 and a burner 40 (look at FIGS. 2 and 6) are located right beneath of said bottom of the ring combustor. The burner 40 is "air-blast gas burner" wherein gas from inlet 44 under a pressure of a gas source is mixing in parallel streams with air from low pressure plenum blower 46 e.g. 500 Pa (50 mm W.C.) in an amount from about 100% and more of stoichiometric requirement for complete combustion. The burner 40 ends with the nozzle 42, extending through the bottom into the ring combustor 23. The nozzle 42 has a tangential direction to the ring combustor and is directed aslant up from horizontal by angles e.g. 10°.

A jet of gas/air mixture blowing tangentialy and aslant up into the ring combustor 22 with velocity e.g. about 30 m/s creates a whirling stream of gases flow upward with a high thermal conductance factor. Moreover, a whirling stream flame constantly flames a gas/air mixture jet by contact with itself.

Figure 2:
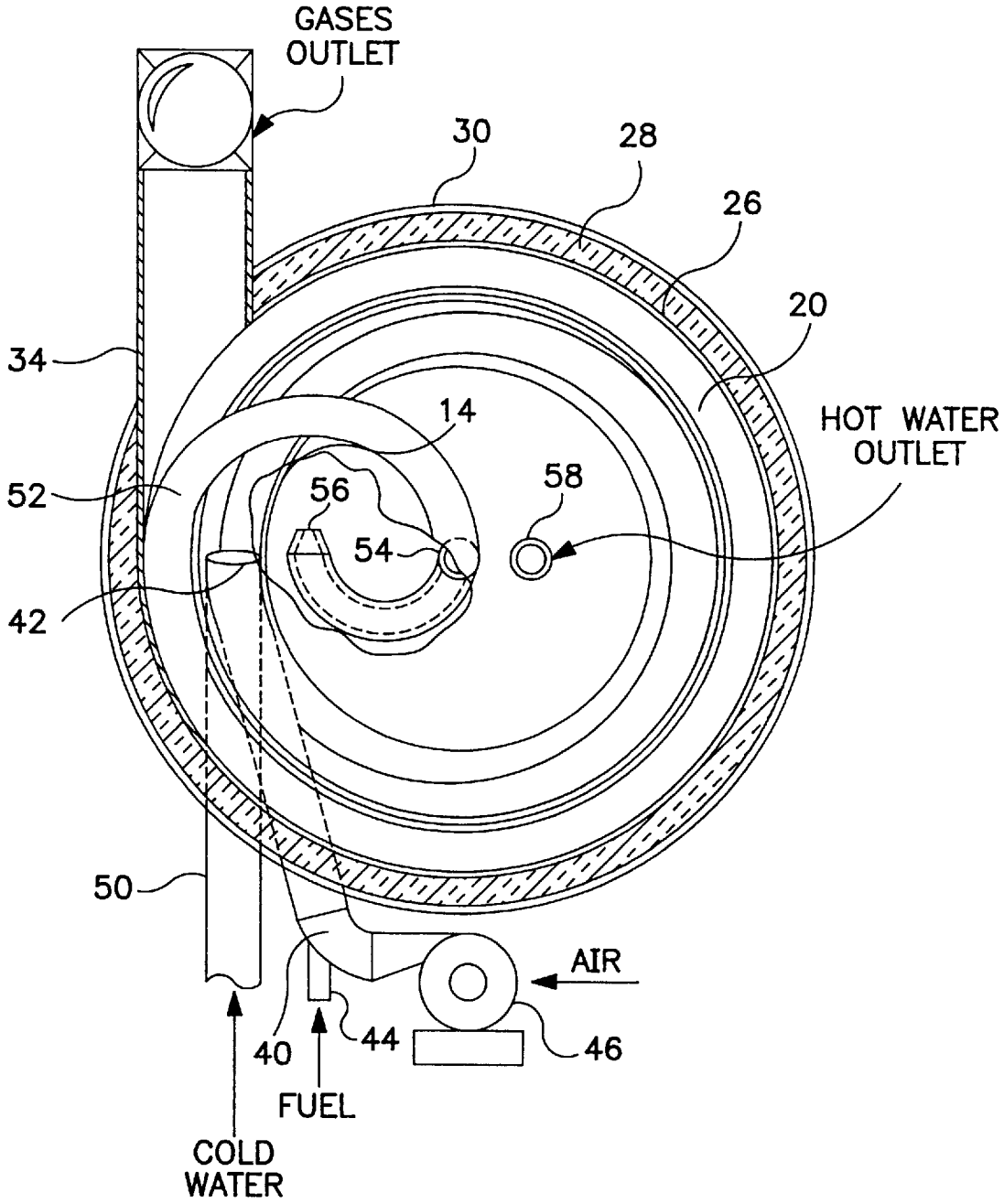
FIG. 2 is a broken away schematic cross-sectional top view taken on line A—A FIG. 1.

In FIGS. 1 and 2 are shown a top cover 32 over the ring flue 22 with a horizontal tangential outlet 34 through which gases blow by action of directed tangential force from a whirling stream products of combustion. Said tangential outlet can be used with or without an injector or an exhauster to convey gases outside of building.

Turning now to the bottom portion of the water heater. A bottom end 50 of the coil pipe is connected with a cold water inlet tube. A top end 52 of the coil pipe is connected with a central tube 54 entering into the tank and passing from top to bottom. This tube ends with a nozzle 56 (look at FIG. 2) which is directed tangentialy to the tank's wall 14 and horizontaly or aslant down under at angles to about 15°. The jet-like stream of cold water from nozzle 56 under a pressure of the cold water source has a suitable velocity to form whirling stream of water in the tank to prevent the tendency of solid particles to precipitate out of the water. Said stream of cold water washes off the precipitate that was accumulated before on bottom 18 of the tank at the time when hot water wasn't withdrawn and, therefore, there was not any movement in the water in the tank.

Furthermore, the whirling water stream going around bottom portion of the tank's wall 14 is necessary for cooling tank's wall to avoid damage of metal from whirling stream of flame with the highest temperature.

The lower portion of the ring combustor 23 can be separated from metal surfaces of the tank and the coil pipe by a refractory screen, e.g. tube-screen 36 as FIG. 1 shows.

Figure 3:
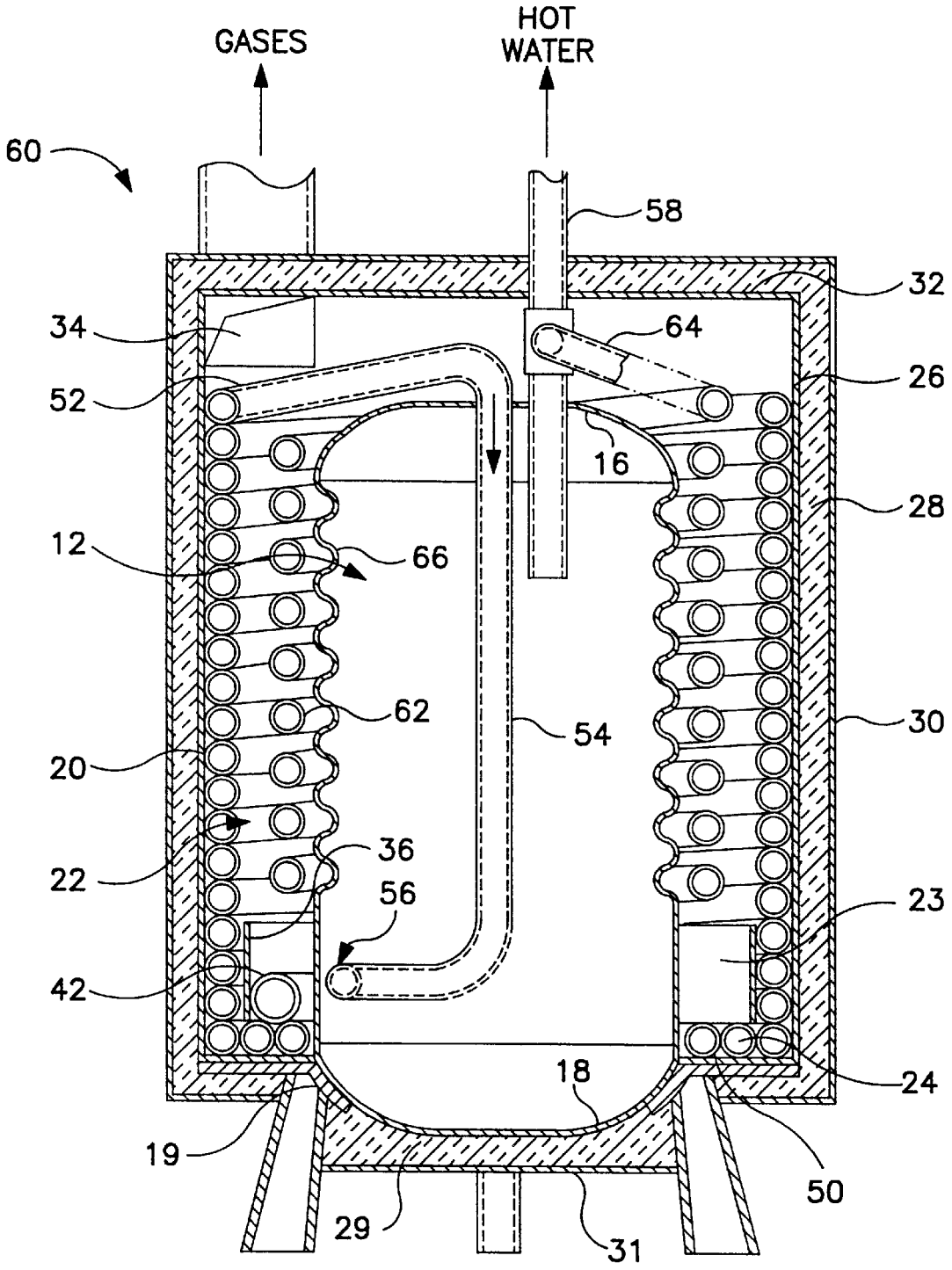
FIG. 3 is a schematic cross-sectional side view of another embodiment of this invention with two coaxial vertical coil pipes located around the tank with hot water.

FIG. 3 shows another embodiment of the water heater 60 with more capacity because of additional coil pipe 62. It is located between the tank 12 and outer coil pipe 20 into ring flue 22. Therefore the spires of that coil pipe are heating because of contact with whirling stream gases all around their surface. In this embodiment each of coil pipe is connected with cool water source separately. The hot water outlet tube 52 from one of coil pipes is running into the tank, and outlet tube 64 from the other coil pipe is joined with hot water outlet 58 from the tank. In FIG. 3 is also shown a wavy structural shape 66 of the tank for more surface to be a conducting area for heat transfer from hot gases to water.

All of the rest details and its numerals including blower assembly with burner are the same as in FIGS. 1 and 2.

Figure 4:
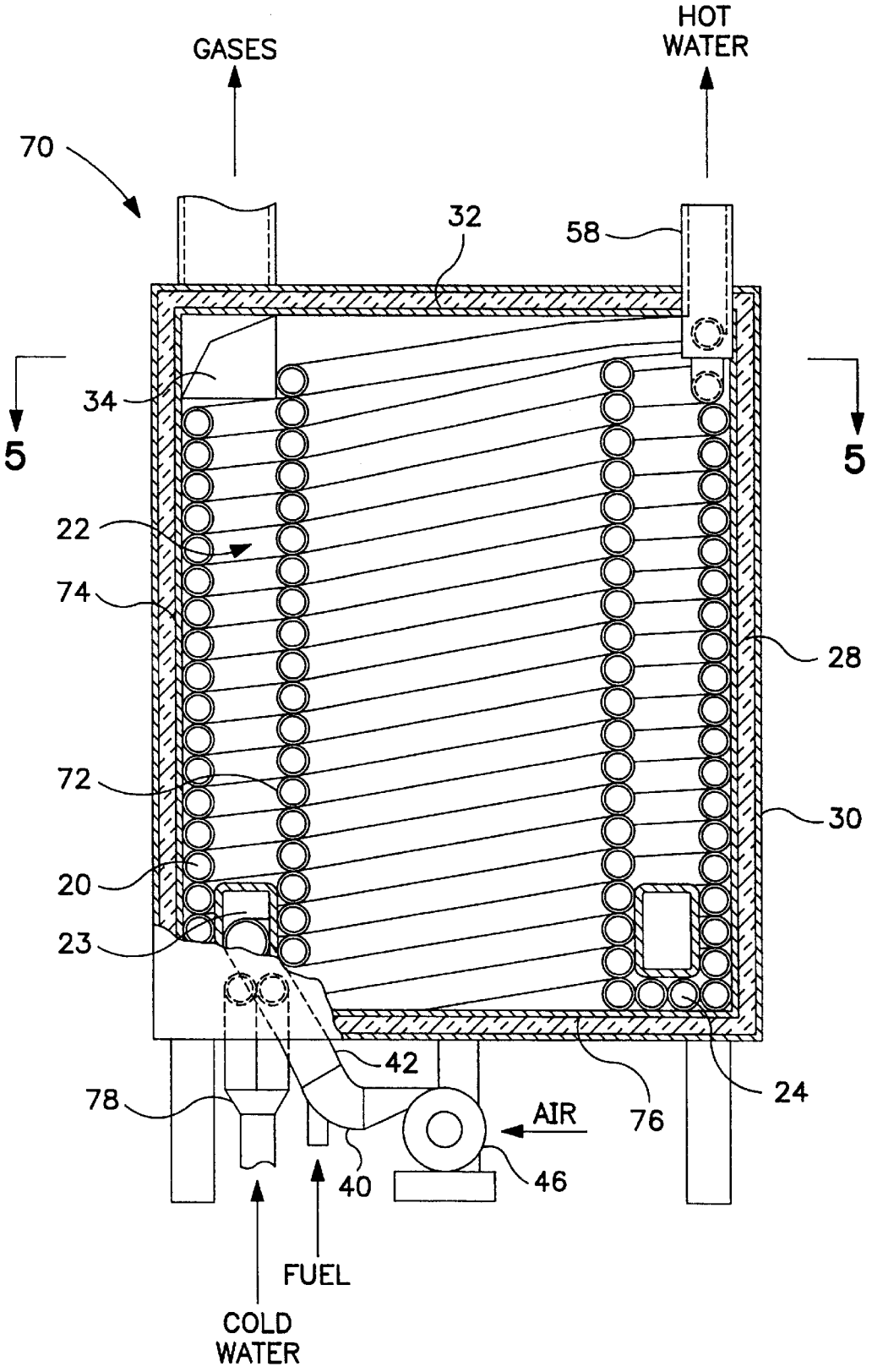
FIG. 4 is a schematic cross-sectional side view of another embodiment of this invention in which there are two coaxial coil pipes without the tank for hot water.
Figure 5:
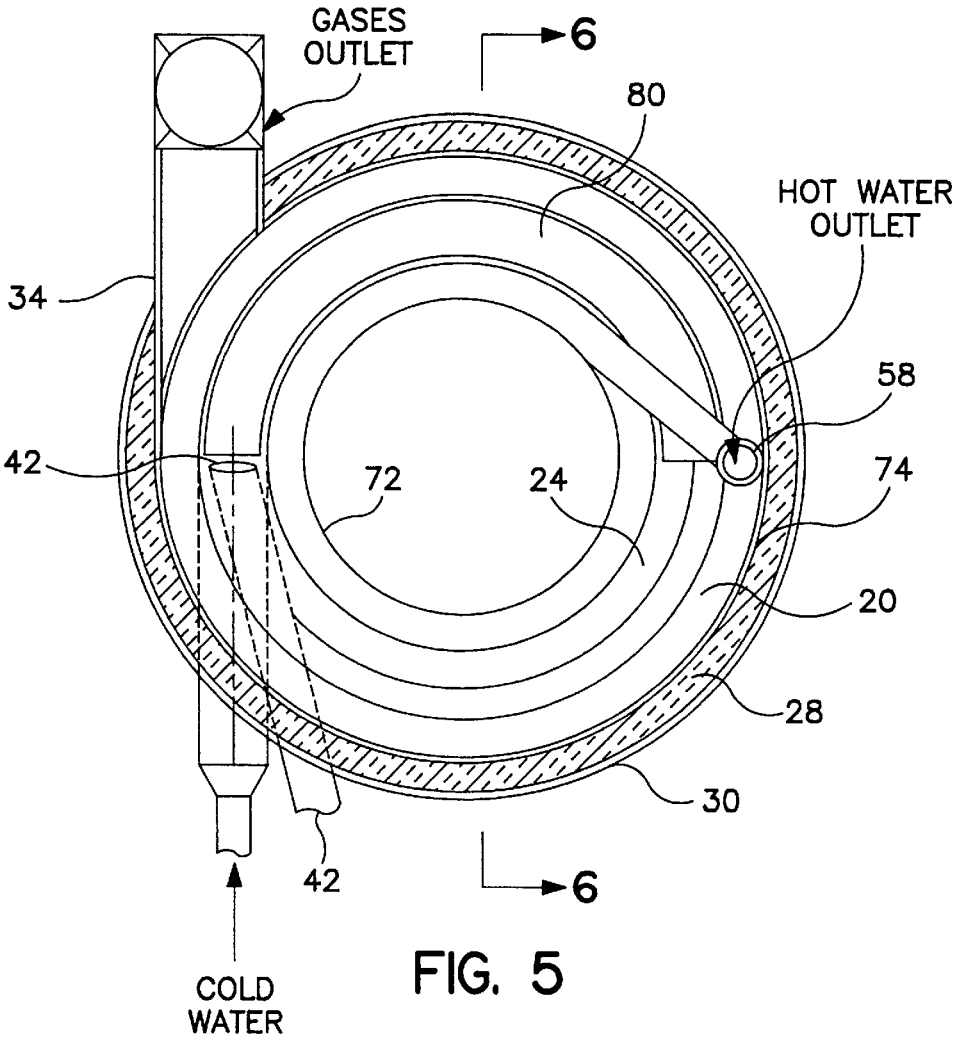
FIG. 5 is a broken away schematic cross-sectional top view taken on line B—B FIG. 4.

FIGS. 4 and 5 show another embodiment 70 of this invention with two coaxial coil pipe, inner 72 and outer 20 with a ring space between them but without of tank for hot water. This construction is working as a boiler.

The coil pipes are joined together with their inlet and outlet ends. The bottom end of that ring space is closed with additional spires 24 of coil pipes. The coil pipes are placed in a metal cylindrical barrel 74 with bottom end 76 and top cover 32. The barrel is covered by insulation 28 and coated by jacket 30 all around them.

The top portion of the barrel near to the top cover 32 has opening for tangential outlet 34 for products of combustion. Hot water outlet 58 is passing through the top cover 32. The exits of said tubes are shown in FIGS. 4 and 5.

Figure 6:
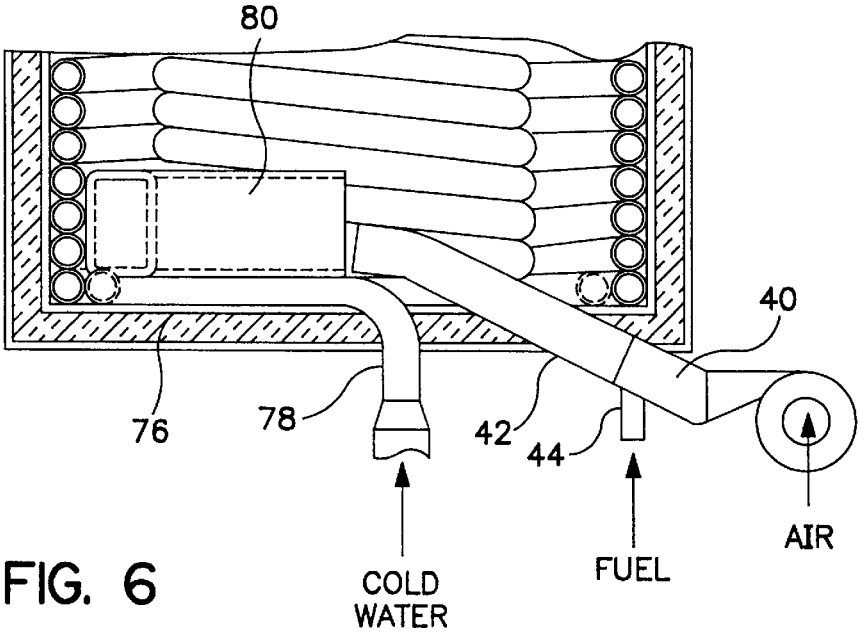
FIG. 6 is a schematic cross-sectional side elevational view of the burner nozzle entrance into the combustor taken on line C—C FIG. 5.

The bottom end 76 of the barrel has openings for burner nozzle 42 and cold water inlet 78. FIG. 6 shows the entrance of the burner nozzle into the ring combustor 23. The burner nozzle is flexed along circumference and going close to said cold water inlet tube 78 and bottom spires 24. Those spires are twisted around the nozzle 42 separating the ring combustion space from outside environment along the hole length of the nozzle's entry. The fireproof tube screen 80 is located on the bottom spires 24 close to the abutting end 80 of the burner nozzle.

Since each embodiment of this invention has well known in the art and used for the same purpose system for control and operation, including spark ignition and/or pilot, description of that means is deemed unnecessary.

We claim:

1. A high efficiency water heater comprising:

a vertical water tight tank adapted to heat and contain hot water under pressure, said tank having a circle-shaped cross-section, a wall defining an outside surface, and bottom and top ends, said tank including a water inlet tube opening and a hot water outlet tube opening, a water inlet tube extending through said water inlet tube opening having an end with at least one nozzle that is directed approximately tangential to the wall of said tank in a bottom portion of the tank;

at least one vertical coil pipe located coaxial around said tank and having an outlet end connected to said water inlet tube for supplying water to said tank, and an inlet end connected with an inlet tube from a source of cold water;

a ring combustor and a vertical flue ring located within a vertical ring space located between said coil pipe and said outside surface of the tank, said ring combustor being located at a bottom portion of said vertical ring space and said vertical ring flue being located above said ring combustor for exhausting products of combustion;

a low pressure plenum blower means for supplying air for combustion of fuel under a pressure from about 500 Pa (50 mm W.C.) and above;

a burner means for receiving fuel from a fuel source and air from said plenum blower in an amount equal from about 100% or greater of a stoichiometric requirement for complete combustion of the fuel and issuing a fuel/air mixture through the bottom end into said ring combustor through the use of at least one nozzle, said nozzle being oriented in a tangential direction to said ring combustor and being directed horizontal or aslant up to angle about 20°;

a layer of insulation and an outside jacket covering said coil pipe; and exhaust means for venting products of combustion from said ring flue.

2. The water heater as in claim 1 wherein said vertical ring flue has a top cover with a tangential outlet for venting products of combustion.

3. The water heater as in claim 2 wherein said vertical tank has a wavy surface in which waves go around one above another at an angle from horizontal up to about 30°.

4. The water heater as in claim 2 wherein the ring combustor includes a bottom end which is closed with additional spires of said coil pipe.

5. The water heater as in claim 2 wherein said ring combustor includes a lower portion which is separated from the surface of said vertical tank and said coil pipe by at least one refractory screen which is adapted to a shape of and placed into said lower portion of the ring combustor.

6. The water heater as in claim 2 wherein said ring combustor includes a lower portion which is separated from the surface of said vertical tank and said coil pipe by at least one refractory screen which is adapted to a shape of and placed into said lower portion of the ring combustor.

7. The water heater as in claim 1 wherein said vertical tank has a wavy surface in which waves go around one above another at an angle from horizontal up to about 30°.

8. The water heater as in claim 7 wherein the ring combustor includes a bottom end which is closed with additional spires of said coil pipe.

9. The water heater as in claim 7 wherein said ring combustor includes a lower portion which is separated from the surface of said vertical tank and said coil pipe by at least one refractory screen which is adapted to a shape of and placed into said lower portion of the ring combustor.

10. The water heater as in claim 7 wherein said ring combustor includes a lower portion which is separated from the surface of said vertical tank and said coil pipe by at least one refractory screen which is adapted to a shape of and placed into said lower portion of the ring combustor.

11. The water heater as in claim 1 wherein the ring combustor includes a bottom end which is closed with additional spires of said coil pipe.

12. The water heater as in claim 11 wherein said ring combustor includes a lower portion which is separated from the surface of said vertical tank and said coil pipe by at least one refractory screen which is adapted to a shape of and placed into said lower portion of the ring combustor.

13. The water heater as in claim 11 wherein said ring combustor includes a lower portion which is separated from the surface of said vertical tank and said coil pipe by at least one refractory screen which is adapted to a shape of and placed into said lower portion of the ring combustor.

14. The water heater as in claim 1 wherein said ring combustor includes a lower portion which is separated from the surface of said vertical tank and said coil pipe by at least one refractory screen which is adapted to a shape of and placed into said lower portion of the ring combustor.

15. The water heater as in claim 14 wherein said ring combustor includes a lower portion which is separated from the surface of said vertical tank and said coil pipe by at least one refractory screen which is adapted to a shape of and placed into said lower portion of the ring combustor.

16. The water heater as in claim 1 wherein said outer coil pipe includes spires wound around said tank, a pitch of said spires of the outer coil pipe is greater than a diameter of the pipe and there is an additional outside metal tube screen located close to an outer surface of the coil pipe.

* * * * *